US007862624B2

(12) United States Patent
Tran

(10) Patent No.: US 7,862,624 B2
(45) Date of Patent: Jan. 4, 2011

(54) NANO-PARTICLES ON FABRIC OR TEXTILE

(76) Inventor: Bao Tran, 6768 Meadow Vista Ct., San Jose, CA (US) 95135

( * ) Notice: Subject to any disclaimer, the term of this patent is extended or adjusted under 35 U.S.C. 154(b) by 1622 days.

(21) Appl. No.: 11/064,262

(22) Filed: Feb. 23, 2005

(65) Prior Publication Data

US 2005/0229328 A1 Oct. 20, 2005

(51) Int. Cl.
*D06M 11/83* (2006.01)

(52) U.S. Cl. ..... 8/115.6; 8/115.51; 600/382; 600/388; 340/540; 428/305.5; 428/306.6; 428/307.7

(58) Field of Classification Search ..... 340/540, 340/870.28; 600/388, 382; 8/115.51, 116; 428/305.5, 306.6, 307.7
See application file for complete search history.

(56) References Cited

U.S. PATENT DOCUMENTS 4,541,908 A 9/1985 Niki et al.
4,668,932 A 5/1987 Drori et al.
5,063,521 A 11/1991 Peterson et al.
5,084,365 A 1/1992 Gratzel et al.
5,084,667 A 1/1992 Drori et al.
5,093,664 A 3/1992 Senn et al.
5,109,204 A 4/1992 Keefer
5,161,157 A 11/1992 Owen et al.
5,296,858 A 3/1994 Moyal
5,581,198 A 12/1996 Trimberger
5,946,034 A 8/1999 Cortiula
5,977,565 A 11/1999 Ishikawa et al.
6,331,768 B1 12/2001 Drori et al.
6,366,318 B1 4/2002 Smith et al.
6,379,753 B1 4/2002 Soane et al.
6,380,336 B1 4/2002 Soane et al.
6,381,482 B1 * 4/2002 Jayaraman et al. ..... 600/388
6,387,492 B2 5/2002 Soane et al.
6,472,476 B1 10/2002 Soane et al.
6,485,530 B1 11/2002 Soane et al.
6,497,732 B1 11/2002 Soane et al.
6,497,733 B1 12/2002 Ware, Jr. et al.
6,500,571 B2 12/2002 Liberatore et al.
6,516,633 B1 2/2003 Erskine et al.
6,517,933 B1 2/2003 Soane et al.
6,544,594 B2 4/2003 Linford et al.
6,570,523 B1 5/2003 Bacrania et al.
6,576,938 B1 6/2003 Hirama et al.
6,599,327 B2 7/2003 Soane et al.
6,605,836 B2 8/2003 Kishi et al.
6,607,564 B2 8/2003 Soane et al.
6,607,994 B2 * 8/2003 Soane et al. ..... 442/59
6,617,267 B2 8/2003 Soane et al.
6,617,268 B1 9/2003 Offord et al.
6,617,364 B2 9/2003 Soane et al.
6,638,984 B2 10/2003 Soane et al.
6,671,166 B1 12/2003 Penneau et al.
6,679,924 B2 1/2004 Ware, Jr. et al.
6,690,599 B2 2/2004 Hasegawa et al.
6,691,536 B2 2/2004 Severns et al.
6,809,653 B1 * 10/2004 Mann et al. ..... 340/870.28
6,821,936 B2 11/2004 Green et al.
6,855,772 B2 2/2005 Linford et al.
7,271,720 B2 * 9/2007 Tabe ..... 340/540
2001/0023986 A1 9/2001 Mancevski
2001/0044114 A1 11/2001 Connolly
2002/0027124 A1 3/2002 Bashir et al.
2002/0071947 A1 6/2002 Soane et al.
2002/0094515 A1 7/2002 Erlach et al.
2002/0096633 A1 7/2002 Gimzewski et al.
2002/0098472 A1 7/2002 Erlach et al.
2002/0114557 A1 8/2002 Zhang et al.
2002/0120988 A1 9/2002 Soane et al.
2002/0122890 A1 9/2002 Linford et al.
2002/0139961 A1 10/2002 Kinoshita et al.
2002/0150524 A1 10/2002 Smalley et al.
2002/0152560 A1 10/2002 Soane et al.
2002/0154535 A1 10/2002 Bocian et al.
2002/0155771 A1 10/2002 Soane et al.
2002/0158374 A1 10/2002 Billiet et al.
2002/0160675 A1 10/2002 Linford et al.
2002/0163414 A1 11/2002 Mayer et al.
2002/0174660 A1 11/2002 Venkatasubramanian
2002/0189024 A1 12/2002 Soane et al.
2003/0003300 A1 1/2003 Korgel et al.
2003/0008078 A1 1/2003 Soane et al.
2003/0008931 A1 1/2003 Soane et al.
2003/0008932 A1 1/2003 Soane et al.
2003/0064532 A1 4/2003 Chen
2003/0079302 A1 5/2003 Soane et al.
2003/0081463 A1 5/2003 Bocian et al.
2003/0082444 A1 5/2003 Kuhr et al.
2003/0089899 A1 5/2003 Lieber et al.
2003/0099834 A1 5/2003 Erskine et al.
2003/0101518 A1 6/2003 Linford et al.
2003/0101522 A1 6/2003 Linford et al.
2003/0104134 A1 6/2003 Linford et al.

(Continued)

*Primary Examiner*—Lorna M Douyon
*Assistant Examiner*—Amina Khan
(74) *Attorney, Agent, or Firm*—Tran & Associates

(57) ABSTRACT

Systems and methods for fabricating a wash durable material includes forming a substrate having strands with void spaces in the strands and between the strands; filling at least a part of the void spaces with nano-particles; and forming projections on the substrate.

18 Claims, 2 Drawing Sheets

U.S. PATENT DOCUMENTS

2003/0111670 A1 6/2003 Misra et al.
2003/0136943 A1 7/2003 Alivisatos et al.
2003/0138777 A1 7/2003 Evans
2003/0139907 A1 7/2003 McCarthy
2003/0141189 A1 7/2003 Lee et al.
2003/0145397 A1 8/2003 Ware, Jr. et al.
2003/0145779 A1 8/2003 Alivisatos et al.
2003/0146095 A1 8/2003 Edman et al.
2003/0169618 A1 9/2003 Lindsey et al.
2003/0171257 A1 9/2003 Stirbl et al.
2003/0174384 A1 9/2003 Halas et al.
2003/0177450 A1 9/2003 Nugent
2003/0178617 A1 9/2003 Appenzeller et al.
2003/0186522 A1 10/2003 Duan et al.
2003/0189402 A1 10/2003 Gaudiana et al.
2003/0200521 A1 10/2003 DeHon et al.
2003/0207978 A1 11/2003 Yadav et al.
2003/0209810 A1 11/2003 Moon et al.
2003/0215903 A1 11/2003 Hyman et al.
2003/0230746 A1 12/2003 Stasiak
2004/0002064 A1 1/2004 Fang et al.
2004/0016318 A1 1/2004 Angeliu
2004/0029706 A1 2/2004 Barrera et al.
2004/0048541 A1 3/2004 Offord et al.
2004/0055093 A1 3/2004 Offord et al.
2004/0078219 A1* 4/2004 Kaylor et al. ..... 705/2
2004/0142168 A1 7/2004 Hrubesh et al.
2004/0194224 A1 10/2004 Offord

* cited by examiner

NANO-PARTICLES ON FABRIC OR TEXTILE

BACKGROUND

The present invention relates generally to a method of processing fabric or textile.

For the cleaning of fabric articles, consumers traditionally have used conventional aqueous immersive wash laundry cleaning or dry cleaning. Conventional laundry cleaning is carried out with relatively large amounts of water, typically in a washing machine at the consumer's home, or in a dedicated place such as a coin laundry. As discussed in U.S. Pat. No. 6,691,536, although washing machines and laundry detergents have become quite sophisticated, the conventional laundry process still exposes the fabric articles to a risk of dye transfer and shrinkage.

Dry cleaning processes typically rely on non-aqueous solvents for cleaning. By avoiding water these processes minimize the risk of shrinkage and wrinkling. The need for handling and recovering large amounts of solvents make these dry cleaning processes unsuitable for use in the consumer's home. The need for dedicated dry cleaning operations makes this form of cleaning inconvenient and expensive for the consumer. More recently, dry cleaning processes have been developed which make use of compressed gases, such as supercritical carbon dioxide, as a dry cleaning medium. Unfortunately these processes have many shortcomings, for example they require very high pressure equipment. Other dry cleaning processes have recently been described which make use of nonsolvents such as perfluorobutylamine. These also have multiple disadvantages, for example the nonsolvent fluid cannot adequately dissolve body soils and is expensive.

Recently, advances in textile technology have resulted in improved fabrics and textiles. For example, U.S. Pat. No. 6,821,936 discloses that silver-containing inorganic microbiocides can be utilized as antimicrobial agents on and within a plethora of different substrates and surfaces. In particular, such microbiocides have been adapted for incorporation within melt spun synthetic fibers in order to provide certain fabrics which selectively and inherently exhibit antimicrobial characteristics. Furthermore, attempts have been made to apply such specific microbiocides on the surfaces of fabrics and yarns with little success from a durability standpoint. A topical treatment with such compounds has never been successfully applied as a durable finish or coating on a fabric or yarn substrate. Although such silver-based agents provide excellent, durable, antimicrobial properties, to date such is the sole manner available within the prior art of providing a long-lasting, wash-resistant, silver-based antimicrobial textile. However, such melt spun fibers are expensive to make due to the large amount of silver-based compound required to provide sufficient antimicrobial activity in relation to the migratory characteristics of such a compound within the fiber itself to its surface. A topical coating is also desirable for textile and film applications, particularly after finishing of the target fabric or film. Such a topical procedure permits treatment of a fabric's individual fibers prior to or after weaving, knitting, and the like, in order to provide greater versatility to the target yarn without altering its physical characteristics. Such a coating, however, must prove to be wash durable, particularly for apparel fabrics, in order to be functionally acceptable. Furthermore, in order to avoid certain problems, it is highly desirable for such a metallized treatment to be electrically non-conductive on the target fabric, yarn, and/or film surface. The '936 patent applies a treatment with silver ions, particularly as constituents of inorganic metal salts or zeolites in the presence of a resin binder, either as a silver-ion overcoat or as a component of a dye bath mixture admixed with the silver-ion antimicrobial compound.

United States Patent Application 20040142168 discloses fibers, and fabrics produced from the fibers, are made water repellent, fire-retardant and/or thermally insulating by filling void spaces in the fibers and/or fabrics with a powdered material. When the powder is sufficiently finely divided, it clings to the fabric's fibers and to itself, resisting the tendency to be removed from the fabric.

SUMMARY

Systems and methods for fabricating a wash durable material includes forming a substrate having strands with void spaces in the strands and between the strands; filling at least a part of the void spaces with nano-particles; and forming projections on the substrate.

Implementations of the above system may include one or more of the following. The substrate can be one of: an individual yarn, a textile, a fabric, or a film. The nano-particles can be an antimicrobial compound, a fireproofing compound, an insulating compound, or an anti-odor compound. The nano-particles can be a metal such as silver, gold, aluminum, or any suitable metals. The nano-particles can also be a non-metal. The projections are self-assembled. Each projection can have a first portion to absorb water and a second portion to repel water. The first portion wicks moisture from skin and the second portion repels moisture from the material. The nano-particles can contract at a predetermined temperature, or expand at a predetermined temperature. The nano-particles substantially remain after the substrate is washed at least 40 times in accordance with the wash procedure of AATCC Test Method 130-1981. For example, at least 80% of the nano-particles remain after the substrate is washed at least 40 times in accordance with the wash procedure of AATCC Test Method 130-1981.

The nano-particle alters textile or fabric substrate to which the coating is applied. In one embodiment, the coating is a film mixed with silver nano-particles. The coating provides nano-sized projections on the fabric to prevent agglomerated water droplets from falling into the troughs of the fabric. Water and dirt are kept on the surface of the fabric with a minimum of surface contact between them and the fabric fibers. As a result, dirt comes off easily when a spray of water is applied. The projections do not compromise the performance characteristics and feel of the fabric.

Since the nano-particles are embedded in the substrate, the nano-coating is durable on such substrates. After a substantial number of standard launderings and dryings, the treatment does not wear away in any appreciable amount and thus the substrate retains its desirable features.

Although antimicrobial activity is one desired characteristic of the nano-treated fabric, yarn, or film, other properties can exist as well. For example, odor-reduction, heat retention, distinct colorations, reduced discolorations, improved yarn and/or fabric strength, resistance to sharp edges, etc., are all either individual or aggregate properties which may be accorded the fabric or textile after treatment with the nano-particles.

DESCRIPTION

Figure 1:
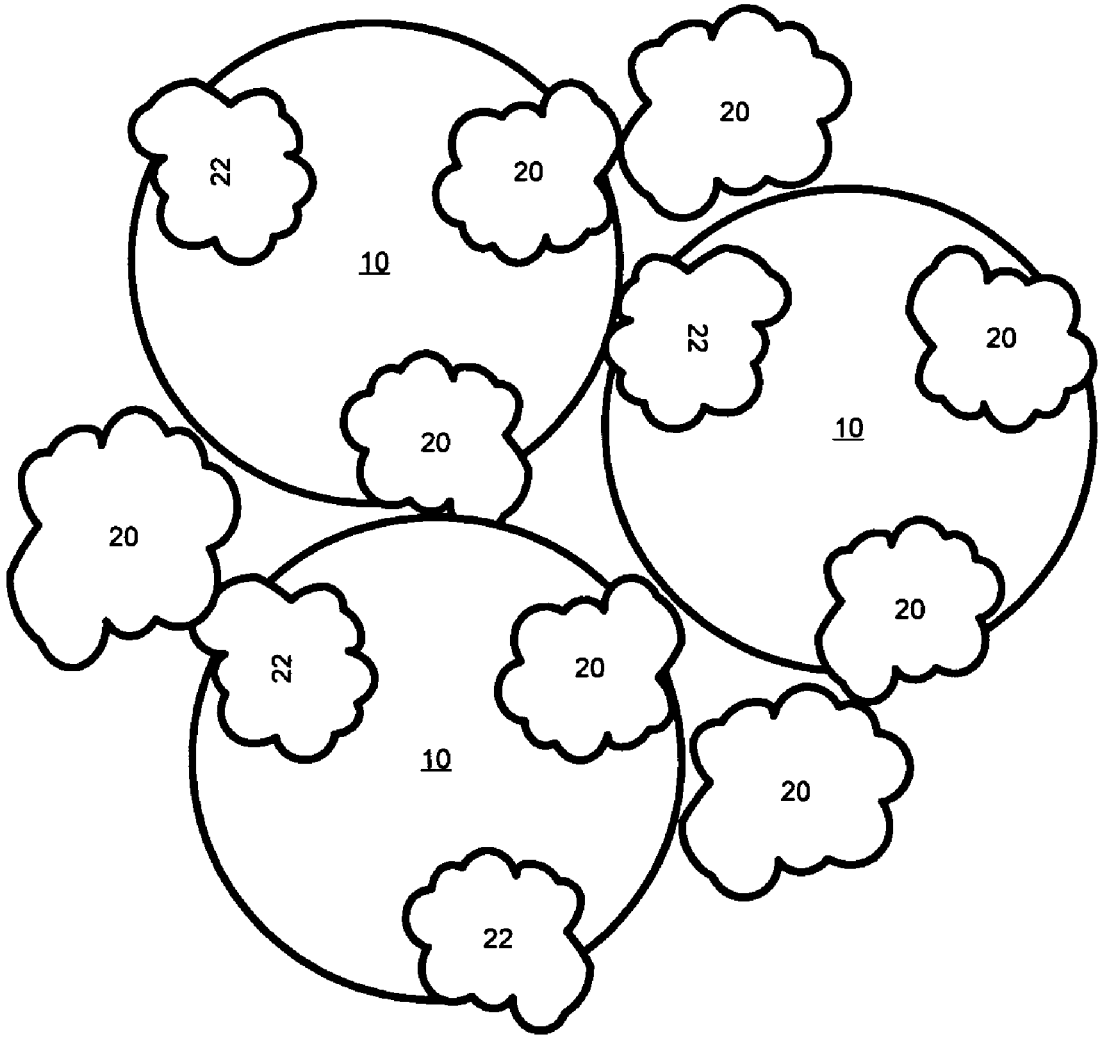
FIG. 1 shows a cross-sectional view of a portion of a substrate made up of strands of smaller fibers.

FIG. 1 shows a cross-sectional view of a portion of a substrate made up of strands of smaller fibers 10. The smaller single fiber strands 10 can be either small porous or non-porous fiber strands. The porous fiber strands can have individual voids 20 and 22. Some of the voids are at least partially filled with particles in the size range below 100 nm. Void volumes can also exist between the smaller single porous or non-porous fiber strands and a portion of the void volume is at least partially filled with particles in the size range of less than 100 nm. In one embodiment, the voids 20 and 22 are provided with a composition having the same nano-particles. Thus, in one example with the same nano-particles, the fabric can be fireproofed. In other embodiments, the voids 20 and 22 are provided with compositions having different nano-particles. Thus, in one example with a plurality of nano-particle types, the voids 20 contain first nano-particles that wick up moisture from the user's skin and the voids 22 contain second nano-particles that repel rain from the fabric.

The substrate includes fibers, woven and non-woven fabrics derived from natural or synthetic fibers or blends of such fibers, as well as cellulose-based papers, and the like. They can include fibers in the form of continuous or discontinuous monofilaments, multifilaments, staple fibers, and yarns containing such filaments and/or fibers, which fibers can be of any desired composition. The fibers can be of natural, man-made, or synthetic origin. Mixtures of natural fibers, man-made fibers, and synthetic fibers can also be used. Examples of natural fibers include cotton, wool, silk, jute, linen, and the like. Examples of man-made fibers include regenerated cellulose rayon, cellulose acetate and regenerated proteins. Examples of synthetic fibers include polyesters (including polyethyleneterephthalate and polypropyleneterephthalate), polyamides (including nylon), acrylics, olefins, aramids, azlons, modacrylics, novoloids, nytrils, aramids, spandex, vinyl polymers and copolymers, vinal, vinyon, Kevlar®, and the like.

The nanosize particles form projections on the outside or sheath of the smaller fibers 10 and the single fiber. The available void spaces in the fibers and between strands of smaller fibers are filled with a nanoporous material. In one embodiment, silver particles are distributed evenly or unevenly along the length of the strand or fiber.

Nano-particles such as silver, gold, aluminum, or similar particles can be used. The nano-particles can be obtained by chemical techniques such as reduction, or non chemical techniques such as laser treatment or mechanical ablation from a solid. The reflecting particles can be coated with a surfactant. The nano-particles impart to the fabric/textile one or more of the cleaning, insulating, waterproofing, and fire resistant properties. Fibers and fabrics produced from the fibers are made water repellent, dirt repellant, fire-retardant and/or thermally insulating by filling the void spaces in the fibers and/or fabrics with a finely powdered material.

The particles can be a nanoporous material, a nanoporous powdered material, a solgel derived material, an aerogel-like material, an aerogel, an insulating material, a thermally insulating material, a water repellant material, a hydrophobic material, a water repellant material, a hydrophobic material, a hydrophobic silica aerogel, a fire resistant material, or a mixture of the foregoing materials. The substrate can be one of: an individual yarn, a textile, a fabric, or a film. The nano-particles can be an antimicrobial compound, a fireproofing compound, an insulating compound, or an anti-odor compound. The nano-particles can be a metal such as silver, gold, aluminum, or any suitable metals. The nano-particles can also be a non-metal. The projections are self-assembled. Each strand can have a first portion to absorb water and a second portion to repel water. The first portion wicks moisture from skin and the second portion repels moisture from the material. The nano-particles can contract at a predetermined temperature, or expand at a predetermined temperature.

The nano-particles can be applied to the substrate containing the strands 10 by soaking, spin casting, dipping, fluid-flow, padding, or spraying a solution containing the nano-particles on the substrate. Next, the substrate with the nano-particles is dried. In one embodiment, the drying occurs at room temperature, thus facilitating manufacturing and minimizes costs while being environmentally friendly.

Since the nano-particles are embedded in the strand, they are secured to the fabric or textile material. The nano-particles substantially remain after the substrate is washed at least 40 times in accordance with the wash procedure of AATCC Test Method 130-1981. For example, at least 80% of the nano-particles remain after the substrate is washed at least 40 times in accordance with the wash procedure of AATCC Test Method 130-1981.

The nano-particles can be applied to natural (cotton, wool, and the like) or synthetic fibers (polyesters, polyamides, polyolefins, and the like) as a substrate, either by itself or in any combinations or mixtures of synthetics, naturals, or blends or both types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, as well as homopolymers, copolymers, or terpolymers in any combination of such monomers, and the like, may be utilized. Nylon 6, Nylon 6,6, polypropylene, and polyethylene terephthalate (a polyester) are particularly preferred. Additionally, the target fabric may be coated with any number of different films, including those listed in greater detail below. Furthermore, the substrate may be dyed or colored to provide other aesthetic features for the end user with any type of colorant, such as, for example, poly(oxyalkylenated) colorants, as well as pigments, dyes, tints, and the like. Other additives may also be present on and/or within the target fabric or yarn, including antistatic agents, brightening compounds, nucleating agents, antioxidants, UV stabilizers, fillers, permanent press finishes, softeners, lubricants, curing accelerators, and the like. Soil release agents can be used to provide hydrophilicity to the surface of polyester. With such a modified surface, again, the fabric imparts improved comfort to a wearer by wicking moisture. In one embodiment, the nano-particles can include copolymers containing a fluorinated monomer, an alkyl monomer, a reactive monomer (e.g., hydroxyethylmethacrylate, N-methylol acrylamide), and various other auxiliary monomers (e.g. vinylidene chloride, polyethylene glycol methacrylate, etc.) that impart water and oil repellent finish to textiles. In yet other embodiments, the nano-particles can include stain-releasing finish with an acrylate copolymer emulsion, an aminoplast resin, a resin catalyst, or polymers that contain carboxyl groups, salts of carboxyl groups.

In another embodiment that achieves wrinkle resistance for cotton substrates, the nano-particles can include alcohol groups on adjacent cellulose chains. The nano-particles are partially crosslinked to keep the chains fixed relative to each other. Crosslinking agents (resins) for durable-press properties include isocyanates, epoxides, divinylsulfones, aldehydes, chlorohydrins, N-methylol compounds, and polycarboxylic acids.

In another aspect, the nano-particles can include Fullerene molecular wires. In one embodiment, the bonding wires can be FSAs or self-assembly assisted by binding to FSA or fullerene nano-wires. Choice of FSAs can also enable self-assembly of compositions whose geometry imparts useful chemical or electrochemical properties including operation as a catalyst for chemical or electrochemical reactions, sorption of specific chemicals, or resistance to attack by specific chemicals, energy storage or resistance to corrosion. Examples of biological properties of FSA self-assembled geometric compositions include operation as a catalyst for biochemical reactions; sorption or reaction site specific biological chemicals, agents or structures; service as a pharmaceutical or therapeutic substance; interaction with living tissue or lack of interaction with living tissue; or as an agent for enabling any form of growth of biological systems as an agent for interaction with electrical, chemical, physical or optical functions of any known biological systems.

FSA assembled geometric structures can also have useful mechanical properties which include but are not limited to a high elastic to modulus weight ratio or a specific elastic stress tensor. Self-assembled structures, or fullerene molecules, alone or in cooperation with one another (the collective set of alternatives will be referred to as "molecule/structure") can be used to create devices with useful properties. For example, the molecule/structure can be attached by physical, chemical, electrostatic, or magnetic means to another structure causing a communication of information by physical, chemical, electrical, optical or biological means between the molecule/structure and other structure to which the molecule/structure is attached or between entities in the vicinity of the molecule/structure. Examples include, but are not limited to, physical communication via magnetic interaction, chemical communication via action of electrolytes or transmission of chemical agents through a solution, electrical communication via transfer of electronic charge, optical communication via interaction with and passage of any form with biological agents between the molecule/structure and another entity with which those agents interact.

The bonding wires can also act as antennas. For example, the lengths, location, and orientation of the molecules can be determined by FSAs so that an electromagnetic field in the vicinity of the molecules induces electrical currents with some known phase relationship within two or more molecules. The spatial, angular and frequency distribution of the electromagnetic field determines the response of the currents within the molecules. The currents induced within the molecules bear a phase relationship determined by the geometry of the array. In addition, application of the FSAs could be used to facilitate interaction between individual tubes or groups of tubes and other entities, which interaction provides any form of communication of stress, strain, electrical signals, electrical currents, or electromagnetic interaction. This interaction provides an "interface" between the self-assembled NANO structure and other known useful devices. In forming an antenna, the length of the NANO tube can be varied to achieve any desired resultant electrical length. The length of the molecule is chosen so that the current flowing within the molecule interacts with an electromagnetic field within the vicinity of the molecule, transferring energy from that electromagnetic field to electrical current in the molecule to energy in the electromagnetic field. This electrical length can be chosen to maximize the current induced in the antenna circuit for any desired frequency range. Or, the electrical length of an antenna element can be chosen to maximize the voltage in the antenna circuit for a desired frequency range. Additionally, a compromise between maximum current and maximum voltage can be designed. A Fullerene NANO tube antenna can also serve as the load for a circuit. The current to the antenna can be varied to produce desired electric and magnetic fields. The length of the NANO tube can be varied to provide desired propagation characteristics. Also, the diameter of the antenna elements can be varied by combining an optimum number of strands of NANO tubes. Further, these individual NANO tube antenna elements can be combined to form an antenna array. The lengths, location, and orientation of the molecules are chosen so that electrical currents within two or more of the molecules act coherently with some known phase relationship, producing or altering an electromagnetic field in the vicinity of the molecules. This coherent interaction of the currents within the molecules acts to define, alter, control, or select the spatial, angular and frequency distributions of the electromagnetic field intensity produced by the action of these currents flowing in the molecules. In another embodiment, the currents induced within the molecules bear a phase relationship determined by the geometry of the array, and these currents themselves produce a secondary electromagnetic field, which is radiated from the array, having a spatial, angular and frequency distribution that is determined by the geometry of the array and its elements. One method of forming antenna arrays is the self-assembly monolayer techniques discussed above.

Various molecules or NANO-elements can be coupled to one or more electrodes in a layer of an IC substrate using standard methods. The coupling can be a direct attachment of the molecule to the electrode, or an indirect attachment (e.g. via a linker). The attachment can be a covalent linkage, an ionic linkage, a linkage driven by hydrogen bonding or can involve no actual chemical attachment, but simply a juxtaposition of the electrode to the molecule. In one embodiment, a "linker" is used to attach the molecule(s) to the electrode. The linker can be electrically conductive or it can be short enough that electrons can pass directly or indirectly between the electrode and a molecule of the storage medium. The manner of linking a wide variety of compounds to various surfaces is well known and is amply illustrated in the literature. Means of coupling the molecules will be recognized by those of skill in the art. The linkage of the storage medium to a surface can be covalent, or by ionic or other non-covalent interactions. The surface and/or the molecule(s) may be specifically derivatized to provide convenient linking groups (e.g. sulfur, hydroxyl, amino, etc.). In one embodiment, the molecules or NANO-elements self-assemble on the desired electrode. Thus, for example, where the working electrode is gold, molecules bearing thiol groups or bearing linkers having thiol groups will self-assemble on the gold surface. Where there is more than one gold electrode, the molecules can be drawn to the desired surface by placing an appropriate (e.g. attractive) charge on the electrode to which they are to be attached and/or placing a "repellant" charge on the electrode that is not to be so coupled.

The FSA bonding wires can be used alone or in conjunction with other elements. A first group of elements includes palladium (Pd), rhodium (Rh), platinum (Pt), and iridium (Ir). As noted in US Patent Application Serial No. 20030209810, in certain situations, the chip pad is formed of aluminum (Al). Accordingly, when a gold-silver (Au—Ag) alloy bonding wire is attached to the chip pad, the Au of the bonding wire diffuses into the chip pad, thereby resulting in a void near the neck. The nano-bonding wire, singly or in combination with the elements of the first group form a barrier layer in the interface between a Au-rich region (bonding wire region) and an Al-rich region (chip pad region) after wire bonding, to prevent diffusion of Au and Ag atoms, thereby suppressing intermetallic compound and Kirkendall void formation. As a result, a reduction in thermal reliability is prevented.

Nano-bonding wires can also be used singly or in combination with a second group of elements that includes boron (B), beryllium (Be), and calcium (Ca). The elements of the second group enhances tensile strength at room temperature and high temperature and suppresses bending or deformation of loops, such as sagging or sweeping, after loop formation. When an ultra low loop is formed, the elements of the second group increase yield strength near the ball neck, and thus reduce or prevent a rupture of the ball neck. Especially, when the bonding wire has a small diameter, a brittle failure near the ball neck can be suppressed.

Nano-bonding wires can also be used singly or in combination with a third group of elements that includes phosphorous (P), antimony (Sb), and bismuth (Bi). The elements of the third group are uniformly dispersed in a Au solid solution to generate a stress field in the gold lattice and thus to enhance the strength of the gold at room temperature. The elements of the third group enhance the tensile strength of the bonding wire and effectively stabilize loop shape and reduce a loop height deviation.

Nano-bonding wires can also be used singly or in combination with a fourth group of elements that includes magnesium (Mg), thallium (TI), zinc (Zn), and tin (Sn). The elements of the fourth group suppress the grain refinement in a free air ball and soften the ball, thereby preventing chip cracking, which is a problem of Au—Ag alloys, and improving thermal reliability.

The nano-bonding wires provide superior electrical characteristics as well as mechanical strength in wire bonding applications. In a wire bonding process, one end of the nano bonding wire is melted by discharging to form a free air ball of a predetermined size and pressed on the chip pad to be bound to the chip pad. The electronics can be embedded inside clothing made from the nano-fabric or textile. The textile/fabric substrate can interconnect a number of other chips. For example, in a plastic flexible clothing substrate, a solar cell is mounted, printed or suitably positioned at a bottom layer to capture photons and convert the photons into energy to run the credit card operation. Display and processor electronics are then mounted or on the plastic substrate. A transceiver chip with nano antennas is also mounted or printed on the plastic substrate. The nano antenna can be the nano-particles embedded into the strands of the fabric/textile substrate.

Figure 2:
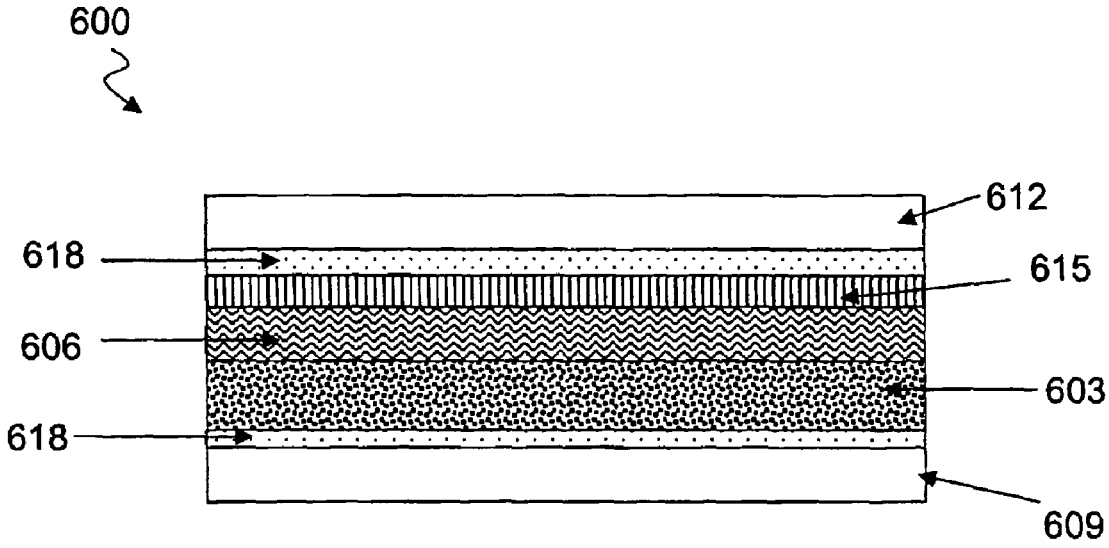
FIG. 2 shows an exemplary embodiment of fabric or textile with solar-cell strands.

In a portion of the substrate, the nano-particles can be a power source. FIG. 2 depicts a flexible photovoltaic cell 600 that is formed with the substrates. The cell 600 includes a photosensitized interconnected nanoparticle material 603 and a charge carrier material 606 disposed between a first flexible, significantly light transmitting substrate 609 and a second flexible, significantly light transmitting substrate 612. In one embodiment, the flexible photovoltaic cell further includes a catalytic media layer 615 disposed between the first substrate 609 and second substrate 612. Preferably, the photovoltaic cell 600 also includes an electrical conductor 618 deposited on one or both of the substrates 609 and 612. The methods of nano particle interconnection provided herein enable construction of the flexible photovoltaic cell 600 at temperatures and heating times compatible with such substrates 609 and 612. The flexible, significantly light transmitting substrates 609 and 612 of the photovoltaic cell 600 preferably include polymeric materials.

Suitable substrate materials include, but are not limited to, PET, polyimide, PEN, polymeric hydrocarbons, cellulosics, or combinations thereof. Further, the substrates 609 and 612 may include materials that facilitate the fabrication of photovoltaic cells by a continuous manufacturing process such as, for example, a roll-to-roll or web process as discussed in US Application Serial No. 20030189402, the content of which is incorporated by reference. The substrate 609 and 612 may be colored or colorless. Preferably, the substrates 609 and 612 are clear and transparent. The substrates 609 and 612 may have one or more substantially planar surfaces or may be substantially non-planar. For example, a non-planar substrate may have a curved or stepped surface (e.g., to form a Fresnel lens) or be otherwise patterned.

An electrical conductor 618 is deposited on one or both of the substrates 609 and 612. Preferably, the electrical conductor 618 is a significantly light transmitting material such as, for example, ITO, a fluorine-doped tin oxide, tin oxide, zinc oxide, or the like. In one illustrative embodiment, the electrical conductor 618 is deposited as a layer between about 100 nm and about 500 nm thick. In another illustrative embodiment, the electrical conductor 618 is between about 150 nm and about 300 nm thick. According to a further feature of the illustrative embodiment, a wire or lead line may be connected to the electrical conductor 618 to electrically connect the photovoltaic cell 600 to an external load.

As noted in Application Serial No. 20030189402, metal oxide nanoparticles are interconnected by contacting the nanoparticles with a suitable polylinker dispersed in a suitable solvent at or below room temperature or at elevated temperatures below about 300° C. The nanoparticles may be contacted with a polylinker solution in many ways. For example, a nanoparticle film may be formed on a substrate and then dipped into a polylinker solution. A nanoparticle film may be formed on a substrate and the polylinker solution sprayed on the film. The polylinker and nanoparticles may be dispersed together in a solution and the solution deposited on a substrate. To prepare nanoparticle dispersions, techniques such as, for example, microfluidizing, attritting, and ball milling may be used. Further, a polylinker solution may be deposited on a substrate and a nanoparticle film deposited on the polylinker. The photosensitized interconnected nanoparticle material 603 may include one or more types of metal oxide nanotubes, as described in detail above. Preferably, the nanotubes contain titanium dioxide particles having an average particle size of about 20 nm. A wide variety of photosensitizing agents may be applied to and/or associated with the nanotubes to produce the photosensitized interconnected nanotube material 603. The photosensitizing agent facilitates conversion of incident visible light into electricity to produce the desired photovoltaic effect. It is believed that the photosensitizing agent absorbs incident light resulting in the excitation of electrons in the photosensitizing agent. The energy of the excited electrons is then transferred from the excitation levels of the photosensitizing agent into a conduction band of the interconnected nanotubes 603. This electron transfer results in an effective separation of charge and the desired photovoltaic effect. Accordingly, the electrons in the conduction band of the interconnected nanotubes are made available to drive an external load electrically connected to the photovoltaic cell. In one illustrative embodiment, the photosensitizing agent is sorbed (e.g., chemisorbed and/or physisorbed) on the interconnected nanotubes 603. The photosensitizing agent may be sorbed on the surfaces of the interconnected nanotubes 603, throughout the interconnected nanotubes 603, or both. The photosensitizing agent is selected, for example, based on its ability to absorb photons in a wavelength range of operation, its ability to produce free electrons (or electron holes) in a conduction band of the interconnected nanotubes 603, and its effectiveness in complexing with or sorbing to the interconnected nanotubes 603. The charge carrier material 606 portion of the photovoltaic cells may form a layer in the photovoltaic cell, be interspersed with the material that forms the photosensitized interconnected nanotube material 603, or be a combination of both. The charge carrier material 606 may be any material that facilitates the transfer of electrical charge from a ground potential or a current source to the interconnected nanotubes 603 (and/or a photosensitizing agent associated therewith). A general class of suitable charge carrier materials can include, but are not limited to solvent based liquid electrolytes, polyelectrolytes, polymeric electrolytes, solid electrolytes, n-type and p-type transporting materials (e.g., conducting polymers), and gel electrolytes.

In another embodiment, nanocrystalline $TiO_2$ is replaced by a monolayer molecular array of short carbon nanotube molecules. The photoactive dye need not be employed since the light energy striking the tubes will be converted into an oscillating electronic current which travels along the tube length. The ability to provide a large charge separation (the length of the tubes in the array) creates a highly efficient cell. A photoactive dye (such as cis-[bisthiacyanato bis(4,4'-dicarboxy-2,2'-bipyridine Ru (II))] can be attached to the end of each nanotube in the array to further enhance the efficiency of the cell. In another embodiment of the present invention, the $TiO_2$ nanostructure described by Grtzel in U.S. Pat. No. 5,084,365 (incorporated herein by reference in its entirety) can serve as an underlying support for assembling an array of SWNT molecules. In this embodiment, SWNTs are attached directly to the $TiO_2$ (by absorptive forces) or first derivatized to provide a linking moiety and then bound to the TiO.sub.2 surface. This structure can be used with or without a photoactive dye as described above.

In yet another embodiment, instead of nanotubes, shape-controlled inorganic nanocrystals can be used. Shape-controlled inorganic nanocrystals offer controlled synthesis that allows not only the prediction of a structure based on computer models, but also the prediction of a precise synthetic recipe that produces that exact structure in high-purity and high-yield, with every particle identical to every other particle. Inorganic semiconductor nanocrystals can control variables such as length, diameter, crystallinity, doping density, heterojunction formation and most importantly composition. Inorganic semiconductor nanocrystals can be fabricated from all of the industrially important semiconductor materials, including all of the Group III-V, Group II-VI and Group IV materials and their alloys, as well as the transition metal oxides. Furthermore, the inorganic semiconductor nanostructures can be fabricated such that material characteristics change controllably throughout the nanostructure to engineer additional functionality (i.e. heterostructures) and complexity into the nanostructure. As discussed in US Application Serial No. 20030145779, three dimensional tetrapods may be important alternatives to nanocrystal fibers and rods as additives for mechanical reinforcement of polymers (e.g., polymeric binders including polyethylene, polypropylene, epoxy functional resins, etc.). Tetrapod shaped nanocrystal particles, for example, can interlock with each other and can serve as a better reinforcing filler in a composite material (e.g., with a binder), than for example, nanospheres. The nanocrystal particles can be mixed with the binder using any suitable mixing apparatus. After the composite material is formed, the composite material can be coated on a substrate, shaped, or further processed in any suitable manner.

An exemplary photovoltaic device may have nanocrystal particles in a binder. This combination can then be sandwiched between two electrodes (e.g., an aluminum electrode and an indium tin oxide electrode) on a substrate to form a photovoltaic device. Two separate mixtures can be used: one containing inorganic semiconductors made of cadmium selenide (CdSe) nanorod molecules and one containing the organic polymer to be blended with the nanorods. The mixtures are then combined and spin-cast at room temperature to produce an even film of nanorods that's approximately 200 nanometers thick—about a thousandth the thickness of a human hair. Tetrapods also have independent tunability of the arm length and the band gap, which is attractive for nanocrystal based solar cells or other types of photovoltaic devices. In comparison to nanocrystal particles that are randomly oriented, the tetrapods are aligned and can provide for a more unidirectional current path than randomly oriented nanocrystal particles.

In one embodiment, each flexible photovoltaic cell further includes one or more flexible light-transmitting substrates, a photosensitized interconnected nanoparticle material, and an electrolyte redox system. In general, the nanotube material and the electrolyte redox system are both disposed between the first and second substrates. The flexible base may be the first significantly light-transmitting substrate of the flexible photovoltaic cell. In one embodiment, the flexible photovoltaic cell further includes a photosensitized nanomatrix layer and a charge carrier medium. The photovoltaic cell may energize the display element directly, or may instead charge a power source in electrical communication with the display element. The display apparatus may further include an addressable processor and/or computer interface, operably connected to the at least one photovoltaic cell, for controlling (or facilitating control of) the display element.

"Semiconductor-nanocrystal" includes semiconducting crystalline particles of all shapes and sizes. They can have at least one dimension less than about 100 nanometers, but they are not so limited. Rods may be of any length. "Nanocrystal", "nanorod" and "nanoparticle" can and are used interchangeably herein. In some embodiments of the invention, the nanocrystal particles may have two or more dimensions that are less than about 100 nanometers. The nanocrystals may be core/shell type or core type. For example, some branched nanocrystal particles according to some embodiments of the invention can have arms that have aspect ratios greater than about 1. In other embodiments, the arms can have aspect ratios greater than about 5, and in some cases, greater than about 10, etc. The widths of the arms may be less than about 200, 100, and even 50 nanometers in some embodiments. For instance, in an exemplary tetrapod with a core and four arms, the core can have a diameter from about 3 to about 4 nanometers, and each arm can have a length of from about 4 to about 50, 100, 200, 500, and even greater than about 1000 nanometers. Of course, the tetrapods and other nanocrystal particles described herein can have other suitable dimensions. In embodiments of the invention, the nanocrystal particles may be single crystalline or polycrystalline in nature.

In addition to interconnect, antenna and solar cells, other nano-particle components can be embedded into the fabric or textile such as sensors, data storage devices, memory and others disclosed in commonly-owned, copending application Ser. No. 11/064,366 entitled "Nano-electronics", the content of which is incorporated by reference.

In one embodiment, nano-sensors are mounted on the patient's clothing. For example, sensors are woven into a single-piece garment (an undershirt) on a weaving machine. An optical fiber is integrated into the structure during the fabric production process without any discontinuities at the armhole or the seams. A nano-interconnection bus transmits information from (and to) sensors mounted at any location on the body thus creating a flexible "bus" structure. The strands or fibers serve as a data bus to carry the information from the sensors (e.g., EKG sensors) on the body. The sensors provide data to the interconnection bus and at the other end similar T-Connectors will be used to transmit the information to monitoring equipment or personal status monitor. Since shapes and sizes of humans will be different, sensors can be positioned on the right locations for all patients and without any constraints being imposed by the clothing. Moreover, the clothing can be laundered without any damage to the sensors themselves.

The above description and drawings are only illustrative of preferred embodiments which achieve the features and advantages of the present invention, and it is not intended that the present invention be limited thereto. The substrates can be used in a variety of ways including, but not limited to various articles of clothing, including informal garments, daily wear, workwear, activewear and sportswear, especially those for, but not limited to easily wet or stained clothing, such as formal garments, coats, hats, shirts, pants, gloves, and the like; other fibrous substrates subject to wetting or staining, such as interior furnishings/upholstery, carpets, awnings, draperies, upholstery for outdoor furniture, protective covers for barbecues and outdoor furniture, automotive and recreational vehicle upholstery, sails for boats, and the like.

Any modification of the present invention which comes within the spirit and scope of the following claims is considered part of the present invention.

What is claimed is:

1. A wash durable material, comprising:

a substrate having strands with void spaces inside the strands; and nano-particles inside the strands filling at least a part of the void with one or more projections from the void spaces through the strands on the substrate, wherein the nano-particles are used with one or more of a metal, a solar cell compound, an interconnect compound, antenna compound, an electronic compound.

2. The material of claim 1 wherein said substrate comprises one of: an individual yarn, a textile, a fabric, a film.

3. The material of claim 1 wherein the nano-particles comprise one of: an antimicrobial compound, a fireproofing compound, an insulating compound, an anti-odor compound.

4. The material of claim 1 wherein the nano-particles comprise one or more sensors to capture patient data.

5. The material of claim 1 wherein the nano-particles comprise:

one or more of: an antimicrobial compound, a fireproofing compound, an insulating compound, an anti-odor compound; and one or more of: a conductor, a solar cell compound, an interconnect compound, antenna compound, an electronic compound.

6. The material of claim 1, wherein the nano-particles comprise one of: silver, gold, aluminum.

7. The material of claim 1, wherein the nano-particles comprise a non-metal.

8. The material of claim 1, wherein the nano-particles substantially remain after the substrate is washed at least 40 times in accordance with the wash procedure of AATCC Test Method 130-1981.

9. The material of claim 1, wherein at least 80% of the nano-particles remain after the substrate is washed at least 40 times in accordance with the wash procedure of AATCC Test Method 130-1981.

10. The material of claim 1, wherein the projections are self-assembled.

11. The material of claim 1, wherein the nano-particles contract at a predetermined temperature.

12. The material of claim 1, wherein the nano-particles expand at a predetermined temperature.

13. The material of claim 1, wherein each projection provides a space between the material and dirt to allow water to easily remove the dirt.

14. The material of claim 1, comprising a first portion to absorb water and a second portion to repel water and wherein the first portion wicks moisture from skin and the second portion repels moisture from the material.

15. A wash durable material, comprising:

a substrate having strands with void spaces in the strands and between the strands; and nano-particles filling at least a part of the void spaces and forming one or more projections on the substrate; and a sensor coupled to a transmitter coupled to an antenna to form a wearable patient monitoring system.

16. A method for fabricating a wash durable material, comprising:

forming a substrate having strands with void spaces in the strands;

filling at least a part of the void spaces with nano-particles; and forming projections from the void spaces through the substrate, wherein the nano-particles comprise sensors to collect patient data.

17. The method of claim 16, wherein said substrate comprises one of: an individual yarn, a textile, a fabric, a film.

18. The method of claim 16, wherein the nano-particles comprise an antimicrobial compound, a fireproofing compound, an insulating compound, an anti-odor compound, solar cell compound, interconnect compound, antenna compound, electronic compound.

* * * * *